United States Patent [19]

Connolly et al.

[11] Patent Number: 4,587,929

[45] Date of Patent: May 13, 1986

[54] CLOSED LOOP MECHANICAL DEVELOPMENT CONTROL SYSTEM

[75] Inventors: Douglas P. Connolly, Webster; Gregory B. Swistak, Rochester; Robert J. Tannascoli, Webster, all of N.Y.

[73] Assignee: Xerox Corporation, Stamford, Conn.

[21] Appl. No.: 677,119

[22] Filed: Nov. 30, 1984

[51] Int. Cl.[4] ..... G03G 15/09

[52] U.S. Cl. ..... 118/657; 118/658; 118/261

[58] Field of Search ..... 118/657, 658, 261; 355/15

[56] References Cited

U.S. PATENT DOCUMENTS

| | | | |
|---|---|---|---|
| 3,924,567 | 12/1975 | Koeleman et al. | 118/637 |
| 4,091,765 | 5/1978 | Lowthorp et al. | 118/658 |
| 4,108,545 | 8/1978 | Eckert, Jr. et al. | 355/14 |
| 4,181,422 | 1/1980 | Forgo et al. | 355/3 DD |
| 4,348,979 | 9/1982 | Daintrey | 118/658 |
| 4,354,763 | 10/1982 | Kaiso et al. | 366/181 |
| 4,387,664 | 6/1983 | Hosono et al. | 118/658 |
| 4,403,852 | 9/1983 | Hirabayashi et al. | 118/658 |
| 4,418,643 | 12/1983 | Barto, Jr. et al. | 118/657 |
| 4,435,065 | 3/1984 | Wada | 355/3 DD |

*Primary Examiner*—John L. Goodrow

[57] ABSTRACT

An apparatus and method for developing an electrostatic latent image on an imaging member wherein a development nip is formed between a rotatably mounted cylindrical developer roll and the imaging member. The nip is initially supplied with a wedge shaped layer of developer material to develop the electrostatic latent image on the imaging member. Periodically at stated intervals the developer material is collected from the developer roll and development nip and the same measured amount of developer material is resupplied to the development nip. The apparatus includes a developer material supply means comprising a developer material hopper having a dispensing aperture at the bottommost portion thereof adjacent the developer roll, a movable dispensing slide in operative association with the developer material hopper, the slide having in succession a solid portion for sealing association with the aperture in the hopper, an aperture for dispensing association with the aperture in the hopper and the cleaning doctor blade for cleaning engagement with the developer roll to collect developer material in the pile as the slide is movable back and forth from sealing association with the hopper aperture and for cleaning the developer roll.

9 Claims, 2 Drawing Figures

CLOSED LOOP MECHANICAL DEVELOPMENT CONTROL SYSTEM

BACKGROUND OF THE INVENTION

CROSS REFERENCE TO RELATED APPLICATION

Attention is directed to U.S. application Ser. No. 614,201 entitled "Removable Process Cartridge for Electrostatographic Reproducing Apparatus" filed on May 25, 1984 in the name of Hoppner et al and commonly assigned to the assignee of the present invention.

The present invention relates to a electrostatographic reproducing apparatus and more particularly to a mechanical development control system for use in such apparatus.

In the electrostatographic reproducing apparatus commonly in use today, a photoconductive insulating member is typically charged to uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure. Alternatively, development may be carried out with a single component developer comprising toner particles which are made from a ferromagnetic material in a suitable resin binder.

One of the most common development techniques for use with both two component (carriers+toner) and single component developer (toner) involves use of a magnetic brush development device. In such a device the developer material is presented to the imaging member by means of a rotatably mounted cylindrical sleeve which has a elongated magnet stationarily positioned with the sleeve to form a magnetic brush of the developer particles. Typically, the rotatable magnetic brush forms a development nip with the image bearing member. During development the copy quality obtained in the developed image depends on the amount of toner material on the developer roll. If insufficient toner material is on the developer roll no development may take place or development of very low density may be perceived. As the amount of toner material present on the roll is increased, it reaches a point where the developed darkness obtained dramatically increases even in fact, provides an overdevelopment of the electrostatic latent image. By overdevelopment we mean that fuzzy heavy lines are produced since the magnetic brush, while it has sufficient time to develop the electrostatic latent image, has insufficient time or developer contained in a development zone to clean up or scavange the background portions of the image. With a slight further increase in the amount of toner present on the development roll the optimum level of copy quality can be obtained. This is a relatively broad range of toner amount that may be present on the roll that provides both adequate development by the toner as well as the scavanging of toner particles initially placed in the background area on the imaging member. Further increases in the amount of toner present on the developer roller beyond this optimum range may lead to spillage and contamination of the machine throughout.

Accordingly, copy quality of the final output copy in such automatic reproducing apparatus depends on having a constant amount of toner on the developer roll. If the amount of toner is below this constant optimum amount the development zone formed within the nip between the developer roll and the photoreceptor may be too small or the amount of toner present there may be insufficient to perform both the development function and the scavanging function. Thus, if the amount of toner runs low poor or thin copy quality is perceived. poor develpment and low scavanging results in fuzzy images and background deposits on the final copy. On the other hand if too much toner is present the possibility of it leaking out of the development system and contaminating the machine is very high. Accordingly there is a desire to maintain the amount of toner present in the development nip within a given quantity range at all times. Thus when toner is removed during the development process additional toner needs to be supplied to the development zone to insure adequate development.

Furthermore to insure proper development and cleaning in the development zone it has been found desirable to extend the development zone from the nip in order to provide sufficient toner as well as development time in which to both develop the image and scavange the background portions of the image. Accordingly toner is pumped into the development zone so as to form a wedge shaped mass of toner above the small nip between the developer roll and the image bearing member. This provides the additional advantage in those electrostatographic reproducing machines which employ a two-cycle process wherein one or more units of the machine perform more than one function, for example, as in the present invention the developing unit may also provide the function for cleaning. This is achieved by forming and developing the electrostatic latent image during the first pass, transferring the image to a copy sheet and cleaning any residual image in the second pass. With the extended development zone during the cleaning cycle when there is no potential applied to the photoconductor a more satisfactory scavanging of the photoreceptor and thereby cleaning is achieved.

PRIOR ART

U.S. Pat. No. 4,481,422 (Forgo) describes a process and apparatus for developing and cleaning an imaging member by means of single magnetic brush wherein the brush has a layer of one component toner and a wedge shaped thickening of a layer of the one component toner in the region of contact by the magnetic brush with the imaging surface and wherein the thickness of the wedge shaped thickening of the layer of the toner is sensed and the supply of toner to the magnetic brush to maintain the wedge shaped thickening of the layer of toner is controlled. A mechanically sensing and controlling system is illustrated and it is also noted that the thickening of toner may be monitored or sensed by an inductive or capacitive device such as, for example, an induction coil arranged near the thickening so that the magnetic toner mass in the thickening alters the inductance of the coil by influencing its magnetic field. The change in inductance can be used to produce a control signal which is transmitted to a device for supplying toner.

SUMMARY OF THE INVENTION

The present invention is directed to an apparatus and method for developing an electrostatic latent image present on an imaging member.

In a principal aspect of the present invention, the process comprises providing a development nip between the developer roll and the imaging member, supplying a measured amount of developer material to the development nip and periodically, at stated intervals, collecting the developer material from the developer roll and development nip and resupplying a constant predetermined measured amount of developer material to the development nip.

In a specific aspect of the present invention, the apparatus includes a rotatably mounted cylindrical developer roll arranged adjacent to an imaging member forming a development nip therebetween, and means for supplying development material to the development nip to form a wedge shaped layer of developer material in the development nip. The developer supply means comprises a developer material hopper having a dispensing aperture at a bottommost portion thereof adjacent the developer roll, a dispensing slide in operative association with the developer material hopper, the slide having in succession a solid portion for sealing association with the hopper dispensing aperature, an aperture for developer material dispensing association with the aperture in said hopper, and a cleaning/doctor blade for cleaning engagement with the developer roll to collect developer material in a pile as the developer roll is rotated, the slide being movable back and forth for sealing and developer material dispensing association with the developer material hopper aperture and for cleaning the developer roll.

In a further aspect of the present invention, means are provided to reciprocate the slide back and forth between the sealing association and developer material dispensing association positions.

In a further aspect of the present invention, the aperture in said slide is positioned relative to the cleaning doctor blade such that when the aperture in said slide is in said dispensing association with said hopper aperture the cleaning/doctor blade is in cleaning engagement with the surface of said developer roll.

In a further aspect of the present invention, the developer roll comprises a magnetic brush development unit including a rotatably mounted elongated cylindrical sleeve having an elongated magnet stationarily mounted interiorly of the sleeve.

In a further aspect of the present invention, the developer roll is adjacent an arcuate portion of the imaging member.

In a further aspect of the present invention, the developer material hopper is positioned directly above the developer roll and the dispensing slide is horizontally movable between the sealing and the developer material association positions.

Accordingly it is an object of the present invention to provide a mechanical closed loop toner management system for an electrostatographic reproducing apparatus.

It is a further object of the present invention to provide a compact, simple, relatively inexpensive toner management system.

It is a further object of the present invention to provide a toner management system which periodically measures the amount of toner in a development nip and in response thereto mechanically and automatically adds additional toner when necessary.

DESCRIPTION OF THE PREFERRED EMBODIMENT

The invention will now be described with reference to preferred embodiment of the closed loop mechanical toner management system in an electrostatographic reproducing apparatus employing same.

Figure 1:
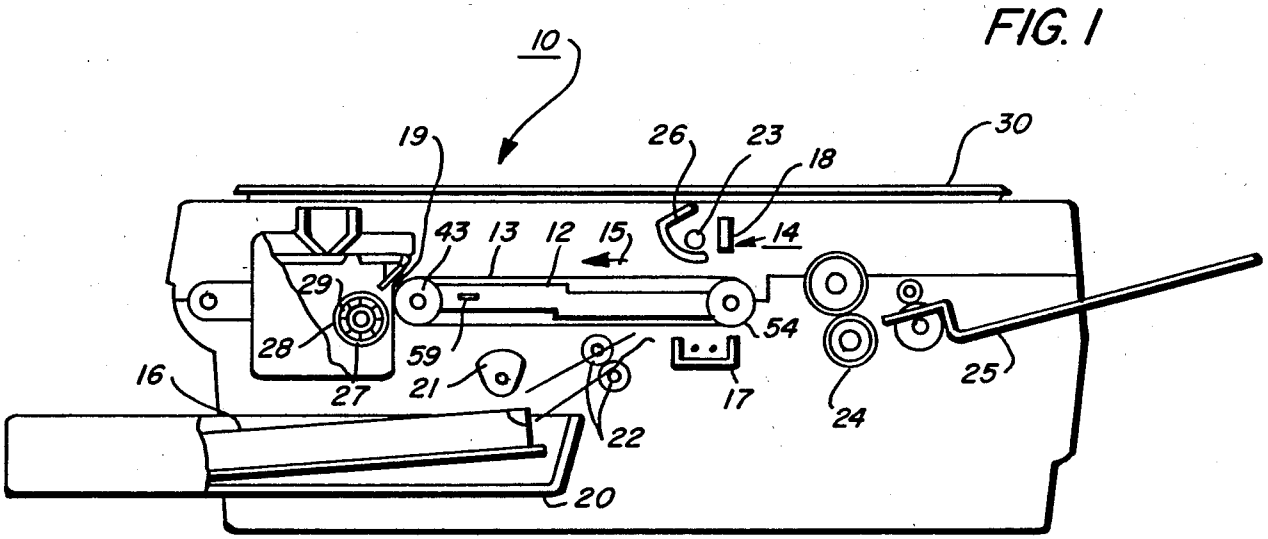
FIG. 1 is a schematic representation in cross section of an automatic electrostatographic reproducing machine in which the mechanical closed loop toner management system may be employed.

Referring now to FIG. 1 there is shown by way of example an automatic xerographic machine 10 which includes the mechanical toner management system of the present invention. The reproducing machine 10 depicted in FIG. 1 illustrates the various components utilized therein for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in application to the particular embodiment or embodiments shown herein.

The automatic reproducing machine 10 is adapted to operate in two-cycle fashion in that the photoreceptor belt is charged, exposed and the resulting electrostatic latent image developed on the first cycle of the belt while the developed toner image on the belt is transferred to a copy sheet as the belt begins its second revolution through the processing stations. Thereafter in the second cycle of operation the belt is cleaned of residual toner by the developer station in preparation for producing the next copy. With this two-cycle geometry a combined charging/transfer unit and a combined developer/cleaning unit are used.

The reproducing machine 10, illustrated in FIGS. 1 and 2 employs an image recording belt like member 12, the outer periphery of which is coated with a suitable photoconductive material 13. The belt 12 is suitably mounted for revolution about driven transport roll 43 and idler roll 54 and travels in the direction indicted by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

Initially, the belt 12 moves the photoconductive surface 13 through a charging/transfer station 17 where in the first cycle, the belt is charged with an electrostatic charge uniformly placed over the photoconductive surface 13 in known manner preparatory to imaging. Thereafter, the belt 12 is driven to exposure station 14 where the charged photoconductive surface 13 is exposed to a light image of the original input scene information whereby the charge is selectively dissipated in the light exposed regions to record the original input scene in the form of an electrostatic latent image. The exposure station preferably comprises a bundle of image transmitting fiber lenses 18, produced under the tradename of "SELFOC" by Nippon Sheet Glass Company, Limited, together with an illuminating lamp 23 and reflector 26. After exposure the belt 12 transports the electrostatic latent image recorded on the photoconductive surface 13 to development/cleaning station 19 wherein a developer is applied to the photoconductive surface of the drum 12 rendering the latent image visible. Typically a suitable development station could include a magnetic brush development system, developer roll 28, comprising a rotatably mounted elongated cylindrical sleeve 27 having an elongated magnet 29 stationarily mounted interiorly of the sleeve with a single component developer comprising toner particles including a ferromagnetic material in a resin binder.

Sheets 16 of the final support material are supported in a stack arrangement on an elevating stack support tray 20. With the stack at its elevated position a sheet separator segmented feed roll 21 feeds individual sheets therefrom to the registration pinch rolls 22. The sheet is then forwarded to the charging/transfer station 17 in proper registration with the image on the belt and the developed image on the photoconductive surface 13 is brought into contact with the sheet 16 of final support material within the charging/transfer station 17 and the toner image is transferred from the photoconductive surface 13 to the contacting side of the final support sheet 16. Following transfer of the image the final support material which may be paper, plastic, etc., as desired is separated from the belt by the beam strength of the support material 16 and, the sheet with the toner image thereon is advanced to a suitable fuser such as roll fuser 24 which fixes the transferred powder image thereto. After the fusing process the sheet 16 is advanced to a suitable output device such as tray 25.

Although a preponderance of toner powder is transferred to the final support material 16, invariably some residual toner remains on the photoconductive surface 13 after the transfer of the toner powder image of the final support material. The residual toner particles remaining on the photoconductive surface 13 after the transfer operation are removed from the belt 12 as it moves in its second cycle through the developing/-cleaning station 19 where the toner particles may be mechanically cleaned from the photoconductive surface 13 by the same magnetic brush as used in developing the electrostatic latent image. To assist in cleaning the belt 12 of the residual toner, a toner particle disturber which may comprise a bar magnet 59 under the belt is positioned to gently disturb the location of the individual toner particles thereby facilitating subsequent cleaning.

Normally, when the copier is operated in a conventional mode, the original document to be reproduced is placed image side down upon a horizontal transparent viewing platen 30 which transports the original past an optical arrangement here illustrated as Selfoc lens 18. The speed of the moving platen and the speed of the photoconductive belt are synchronized to provide a faithful reproduction of the original document.

It is believed that the foregoing general description is sufficient for the purposes of the present application to illustrate the general operation of an automatic xerographic copier 10 which can embody the apparatus in accordance with the present invention.

FIGS. *2a* through *2f* illustrate the mechanical closed loop toner management system according to the present invention in greater detail and in particular illustrate the system during various stages of operation. In FIG. *2a* the developer roll 28 is illustrated as being underneath the toner hopper 33. While this is the preferred embodiment it should be noted that the hopper may be displaced slightly to one side or the other side and still function in the manner to be hereinafter described. The toner management system comprises in addition to hopper 33 a hopper flange 34 attached to the hopper 33 for supporting and sliding engagement with dispensing slide member 38. At the bottom of the hopper 33 is a hopper aperture 36 through which toner may be dispensed. Dispensing slide 38 includes a solid blocking portion 37 and a aperture 39 which when in engagement with or opposite the aperture 36 in the toner hopper 33 enables toner to be dispensed to the developer roll. At the right end of the slide 38 is a scrapper and doctor blade 40 fixedly mounted to the slide 38. FIG. *2a* illustrates the position of the several elements of the present invention wherein an image on belt 12 is being developed by developer roll 28 to produce a copy. In the copying mode toner material is present as a layer 41 on the developer roll and as a wedge 42 in the nip formed between the developer roll 28 and the photoconductive belt 12. The rotational motion of the developer roll together with the motion of the belt 12 around drive roll 43 forms a development nip through which the toner is pumped. The wedge of toner material 42 provides an extended development zone wherein as illustrated development can commence immediately upon contact with the wedge shaped mass of toner and extend through the development zone. In FIG. *2a* toner material is present in the wedge as well as on the surface of the developer roll as it rotates. The dispensing slide 38 is positioned to the far right in a standby position so that the toner hopper is sealed therefore no toner can be dispensed and the scrapper doctor blade is out of contact with the developer roll.

Figure 2A:
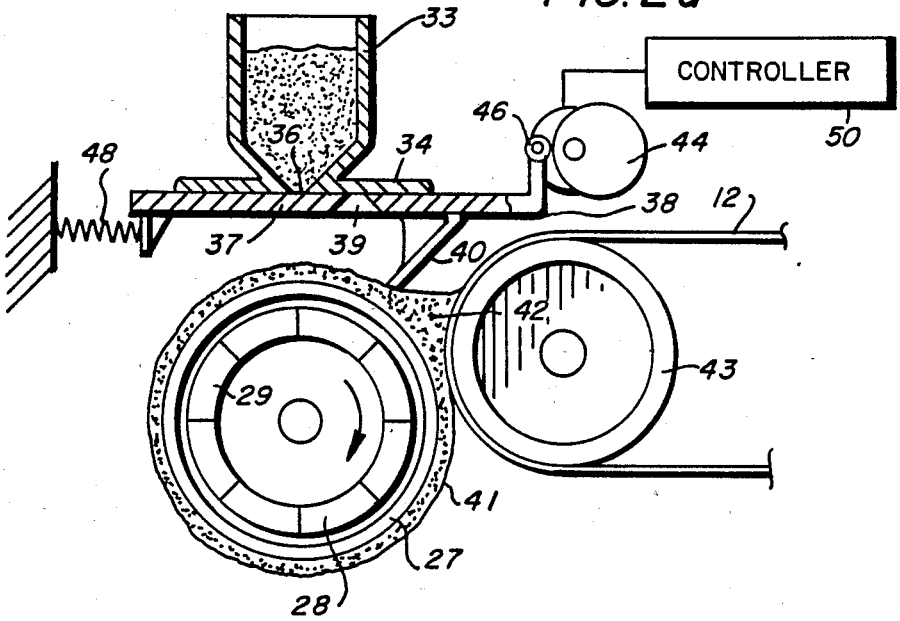
FIGS. 2*a* through 2*f* are schematic representations in cross section of the closed loop mechanical toner management system of the present invention together with magnetic brush developer roll and the imaging member forming the development nip.
Figure 2B:
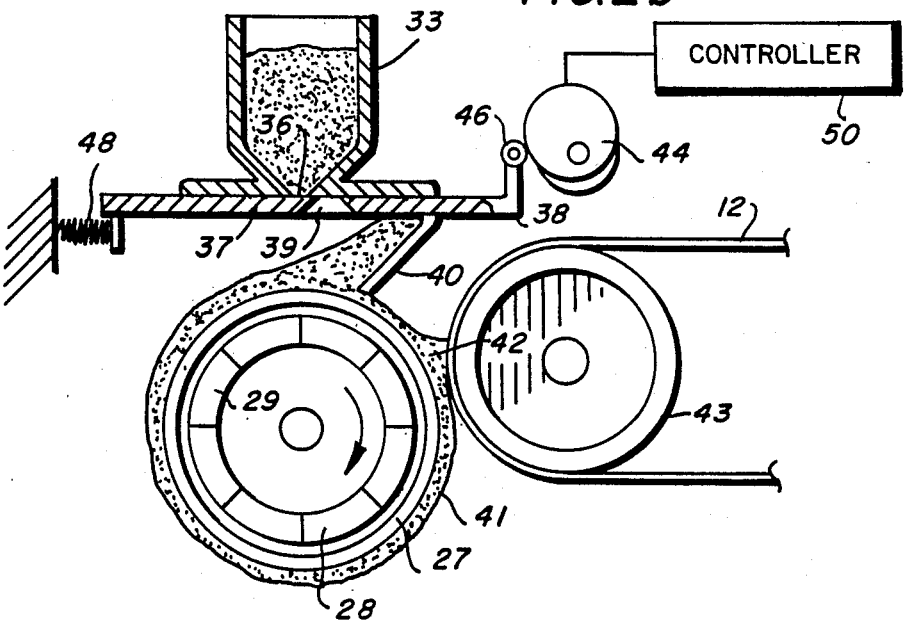
Figure 2C:
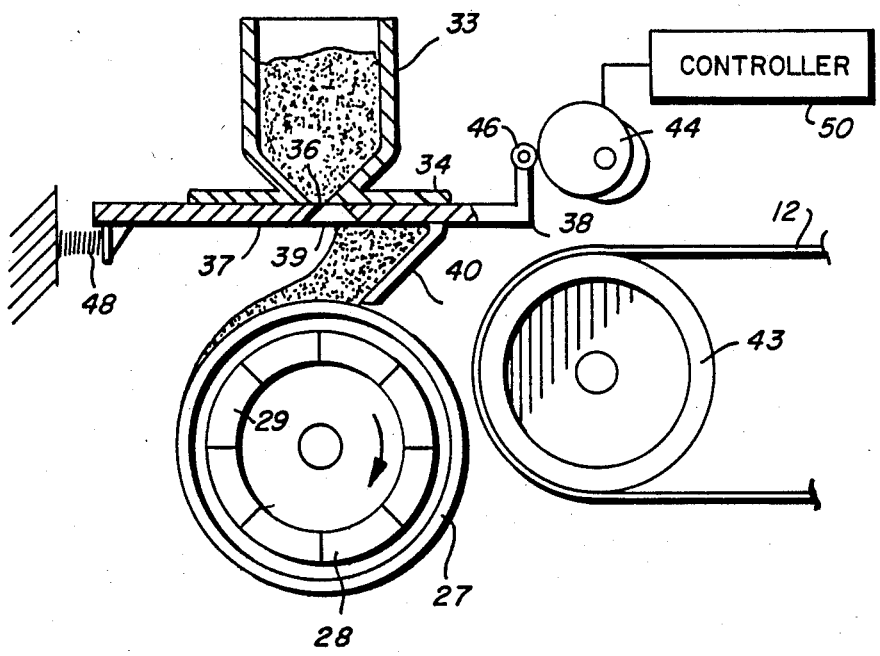

FIG. *2b* illustrates the position of the respective elements at the end of a copying run wherein the dispensing slide 38 is being driven to the left by means of cam 44 in contact with cam follower 46 connected to the end of dispensing slide 38. The dispensing slide 38 is biased to the right by means of compression spring 48. As the slide traverses to the left, the scrapper doctor blade comes into contact with the toner layer 41 on the developer roll with a portion of the layer starting to backup or collect behind the scrapper blade 40. As observed the amount of toner in the wedge 42 has been depleted and the size of the extended development zone has been diminished. At this particular time the apertures in the toner hopper and in the dispensing slide are still not lined up and accordingly no toner is being dispensed. FIG. *2c* illustrates the next condition wherein the developer roll is still turning and the toner material on the roll has been substantially collected behind the scrapper doctor blade and the toner wedge has been depleted. At this point the aperture 36 in the toner hopper is on the edge of the aperture 39 in the dispensing slide. As soon as a small portion of aperture 36 and aperture 39 are aligned and if the mass of toner collected by the scrapping blade in moving to the left does not cover the aperture a small amount of toner will be dispensed. As the magnetic brush rotates and toner is collected behind the doctor/scraper blade and the layer of toner on the developer roll is depleted the stationary magnet 29 inside the developer roll holds any remaining toner on the surface of sleeve 27 in the manner as indicated in FIG. 2*c*.

Figure 2D:
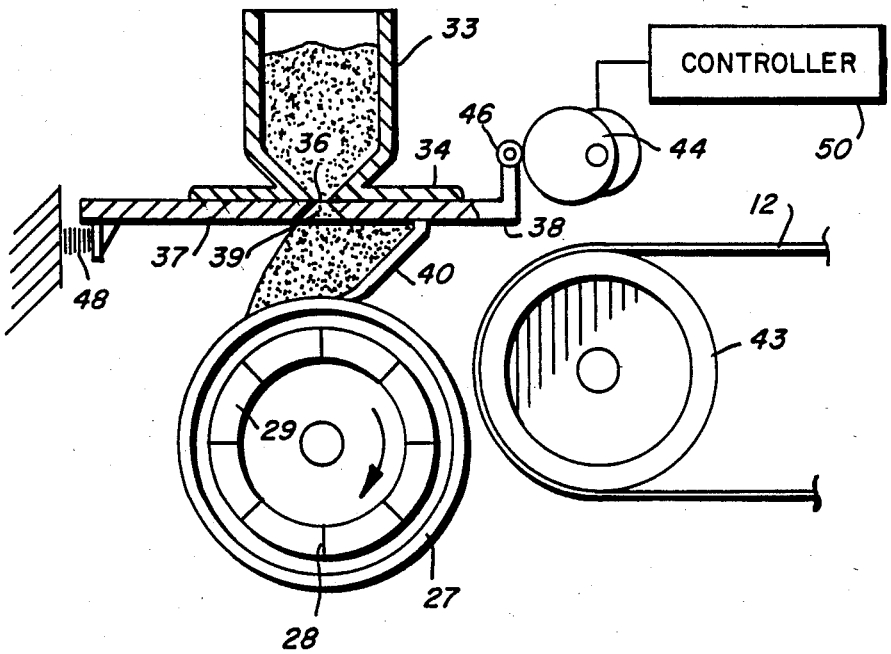

FIG. 2*d* illustrates the position in which the aperture in the toner hopper 36 is in dispensing engagement with the aperture 39 in the dispensing slide. This figure illustrates the condition wherein sufficient toner has been collected by doctor scrapper blade 40 as it traverses to the left to block the apertures 36 and 39 therefore no additional toner material is dispensed.

Figure 2E:
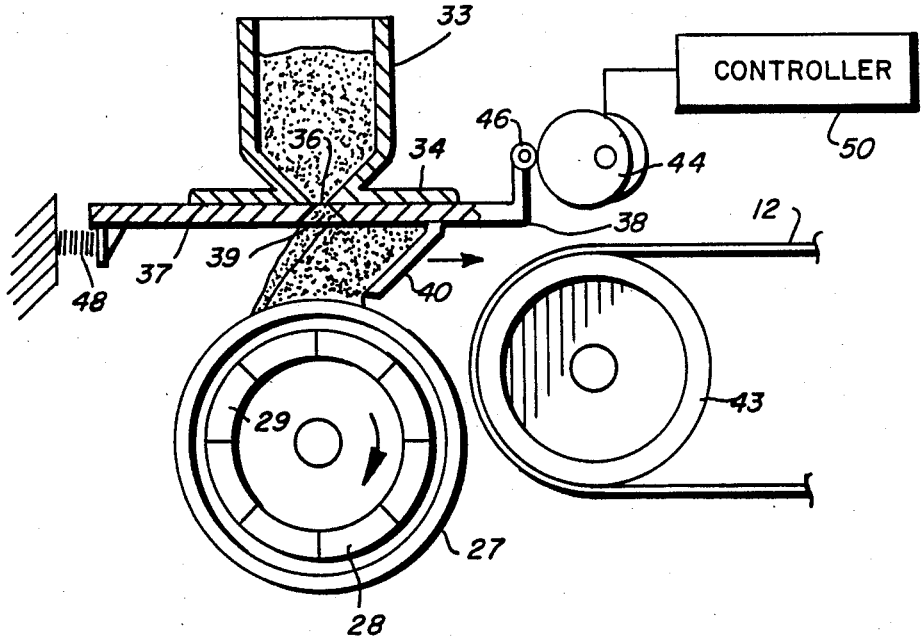

FIG. 2*e* illustrates the condition wherein the amount of toner collected by the scrapper doctor blade in traversing to the left is insufficient to block the mating hopper and dispensing slide apertures and accordingly the toner level is low and additional toner will be dispensed.

Figure 2F:
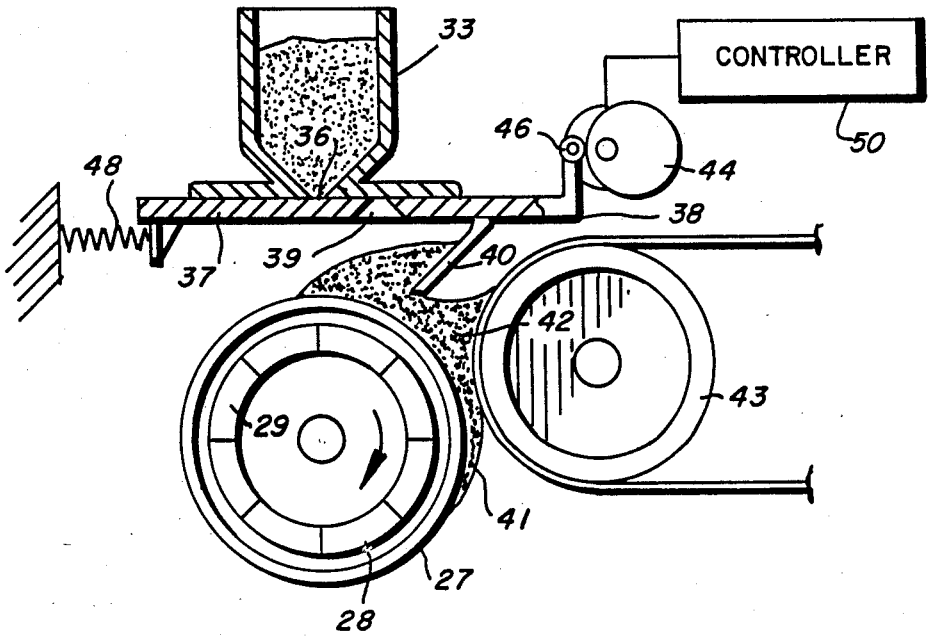

FIG. 2*f* illustrates the condition in which a new copying run is being commenced with the dispensing slide 38 being forced to the right by spring 48 thereby closing off the toner hopper aperture 36 by the blocking portion 37 and removing the scrapper doctor blade 40 from engagement with the surface of the developer roll. At this time as the developer roll rotates it transports the toner at the top of the developer roll that has been collected or dispensed back into the development nip and once again forms the wedge of toner to form the extended development zone.

The illustrated mechanical closed loop toner management system periodically measures the amount of toner in the extended development zone by collecting it in the manner indicated opposite the apertures in the toner hopper and the dispensing slide and in response thereto adds additional toner that may be required. As noted it will add additional toner only when the matching apertures are not completely filled. The geometry of the system is selected such that the volume of the sizing chamber formed between the developer roll, the scrapper/doctor blade when in contact with the developer roll and when both the toner hopper aperture and the slide aperture are aligned is equal to the amount of toner desired to form the extended development zone when all the toner has been transported into it. Accordingly the amount of toner added when the toner hopper aperture and the dispensing slide aperture are aligned is limited by the geometric design since the sizing chamber is filled with toner in a compacted state which has been collected by the doctor scrapper blade as the developer roll turns before the slots are aligned for replenishment. The amount of toner to be added when the dispensing slots are aligned of course can be adjusted by merely moving the toner hopper up or down relative to the developer roll.

Accordingly, the amount of toner present in the extended development zone can be periodically controlled by actuating the slide mechanism. The actuation of the slide mechanism may be controlled in any suitable way. Typically it may be controlled based of the number of copies produced or based on time depending upon the capacity and the consumption of toner in the particular development run. It does not have to be actuated for every copy cycle. For example, in a small copier wherein you are capable of automatically dialing up to say 9 copies it may be actuated at the end of each copy run. In larger reproducing apparatus the operation of the machine may be programmed by controller 50 to stop the copy cycle every say 20 or 30 copies to run through a development zone resizing cycle in the manner indicated.

While the means of actuating the dispensing slide mechanism and thereby the closed loop toner management system has been illustrated with the use of a cam and spring providing the push pull effect to the slide it should be noted that the dispensing slide may be actuated with a variety of other manners. In addition to being capable of being manually actuated by means of a push pull rod it could be driven by a worm gear and a separate motor, or actuated by a solenoid or alternatively driven by a wrap spring clutch driven from the main drive. During the sliding mechanism of the dispensing slide 38 it is important to provide a good sealing arrangement between the bottom of the hopper flange 34 and the dispensing slide 38 in order to minimize, if not eliminate, contamination of the machine by toner escaping through this mechanism.

Thus it may be readily appreciated by reference to the foregoing description when taken with the drawings that the present invention provides a relatively simple, inexpensive, highly reliable closed loop mechanical toner management system. It furthermore has the advantage of not requiring separate complex electrical components such as printed circuit boards.

The disclosures of the patents and patent applications referred to herein are hereby specifically and totally incorporated herein by reference.

While the invention has been described with reference to specific embodiments it will be apparent to those skilled in the art that many alternatives modifications and variations may be made. For example, while the invention has been illustrated with a toner dispenser in a single component magnetic brush development unit, it will be understood that toner management system could be used to dispense toner for a two component developer unit and indeed could itself be used to replenish two component developer. Furthermore while it has been described as being useful in a two-cycle process employing a magnetic brush development unit, it will be understood that it could be used in a single cycle imaging process using other magnetic brush development.

What is claimed is:

1. An apparatus for developing an electrostatic latent image on an imaging member comprising a rotatably mounted cylindrical developer roll arranged adjacent to an imaging member forming a development nip therebetween;

means for supplying developer material to the development nip to form a wedge shaped layer of developer material in the development nip, said developer material supply means comprising a developer material hopper having a dispensing aperture at a bottommost portion thereof adjacent the developer roll, a dispensing slide in operative association with said developer material hopper, said slide having in succession, a solid portion for sealing association with said hopper dispensing aperture, an aperture for developer material dispensing association with the aperture in said hopper and a cleaning/doctor blade for cleaning engagement with said developer roll to collect developer material in a pile as said developer roll is rotated, said slide being movable back and forth for sealing and developer material dispensing association with the developer material hopper aperture and for cleaning the developer roll.

2. The apparatus of claim 1, wherein said developer roll is adjacent an arcuate portion of the imaging member.

3. The apparatus of claim 1, further including means to reciprocate said slide back and forth between its sealing association, and developer material dispensing association position.

4. The apparatus of claim 3, wherein when said aperture in said slide is in dispensing association with said hopper aperture said cleaning doctor blade is in the cleaning engagement with the surface of said developer roll.

5. The apparatus of claim 1, wherein said developer roll comprises a magnetic brush development unit including a rotatably mounted elongated cylindrical sleeve having an elongated magnet stationarily mounted interiorly of the sleeve.

6. The apparatus of claim 1, wherein said developer material hopper is positioned directly above said developer roll and said dispensing slide is horizontally movable betwen the sealing and developer material dispensing positions.

7. A process for developing an electrostatic latent image on an imaging member comprising providing a development nip between a developer roll and the imaging member, supplying a measured amount of developer material to said development nip periodically at stated intervals collecting said developer material from the developer roll and development nip and resupplying the same measured amount of developer material to said development nip.

8. The process of claim 7 wherein said developer material is a single component magnitizable toner.

9. The process of claim 7 comprising the step of providing a developer material supplying means above the developer roll comprising a developer material hopper with a dispensing aperture at a bottommost portion thereof, a dispensing slide in operative association with the hopper, said slide having in succession a solid portion for sealing association with said hopper, an aperture for dispensing association with the aperture in said hopper and a cleaning/doctor blade for cleaning engagement with the developer roll, the cleaning/doctor blade being spaced from the aperture in the slide such that when the slide is in dispensing association with the hopper aperture the blade is in cleaning engagement with the developer roll, periodically reciprocating said dispensing slide from dispensing association with the aperture in said hopper to sealing association with said hopper to initially deliver the measured amount of developer material to the developer roll and the development nip and to clean developer material from the developer roll and development nip.

* * * * *